US005762133A

United States Patent [19]

Dion

[11] Patent Number: 5,762,133

[45] Date of Patent: Jun. 9, 1998

[54] HEAT EXCHANGER TUBE WITH DUCTS FOR COUNTER CURRENT FLUID FLOW

[75] Inventor: Olivier Dion, Le Mans, France

[73] Assignee: Valeo Climatisation, La Verriere, France

[21] Appl. No.: 716,574

[22] Filed: Sep. 19, 1996

[30] Foreign Application Priority Data

Sep. 20, 1995 [FR] France ..... 95 11046

[51] Int. Cl.[6] ..... F28D 1/03; F28F 1/40

[52] U.S. Cl. ..... 165/176; 165/177; 165/173

[58] Field of Search ..... 165/173, 176, 165/177; 29/890.043

[56] References Cited

U.S. PATENT DOCUMENTS

| | | | |
|---|---|---|---|
| 4,513,811 | 4/1985 | Lesniak | 165/79 |
| 5,067,235 | 11/1991 | Kato et al. | 29/890.043 |
| 5,125,453 | 6/1992 | Bertrand et al. | 165/153 |
| 5,366,006 | 11/1994 | Lu et al. | 165/173 |
| 5,441,106 | 8/1995 | Yukitake | 165/183 |

FOREIGN PATENT DOCUMENTS

| | | |
|---|---|---|
| 0 319 520 | 6/1989 | European Pat. Off. . |
| 0 632 245 | 6/1994 | European Pat. Off. . |
| 14 51 219 | 4/1969 | Germany . |
| 2 166 862 | 5/1986 | United Kingdom . |

OTHER PUBLICATIONS

Patent Abstracts of Japan, vol. 12, n0 227 (M-713)m 28 Jun. 1988 & JP-A-63 021494 (Nippon Denso Co Ltd), 29 Jan. 1988.

French Search Report dated 1 Apr. 1996.

*Primary Examiner*—Allen J. Flanigan
*Attorney, Agent, or Firm*—Morgan & Finnegan L.L.P.

[57] ABSTRACT

A heat exchanger, in particular a heat exchanger for a motor vehicle, has a plurality of tubes, each of which comprises a press-formed metal blank rolled on itself to form a casing defining two parallel ducts for flow of a fluid in counterflow mode between them. The ducts are separated by a longitudinal bulkhead, and the tube has a first end portion and a second end portion. The first end portion is arranged for connection to a header having two compartments. The second end of each individual tube is closed so as to obturate the two ducts, and at least two communication apertures are formed in the bulkhead in the vicinity of the second end.

10 Claims, 1 Drawing Sheet

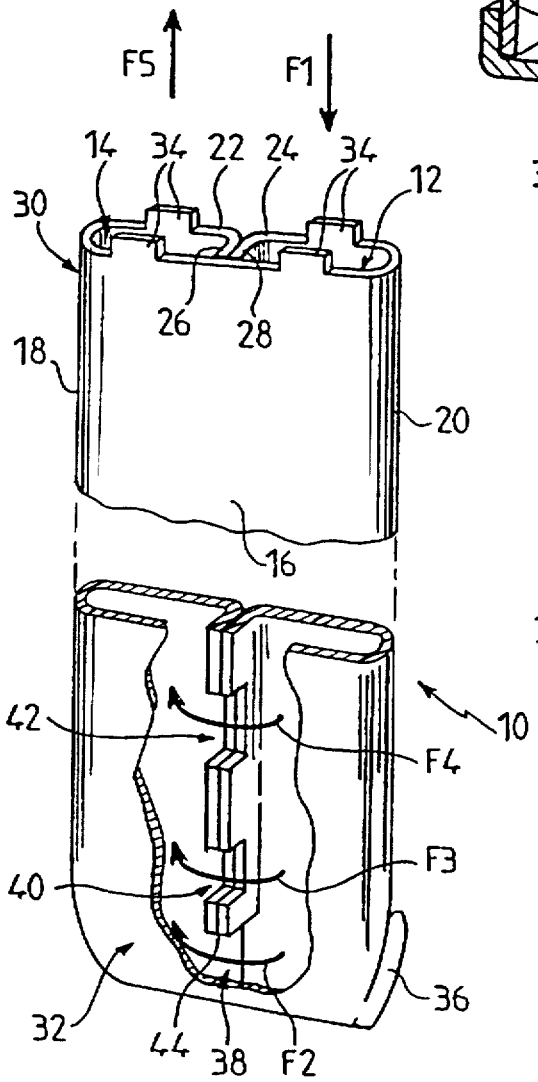
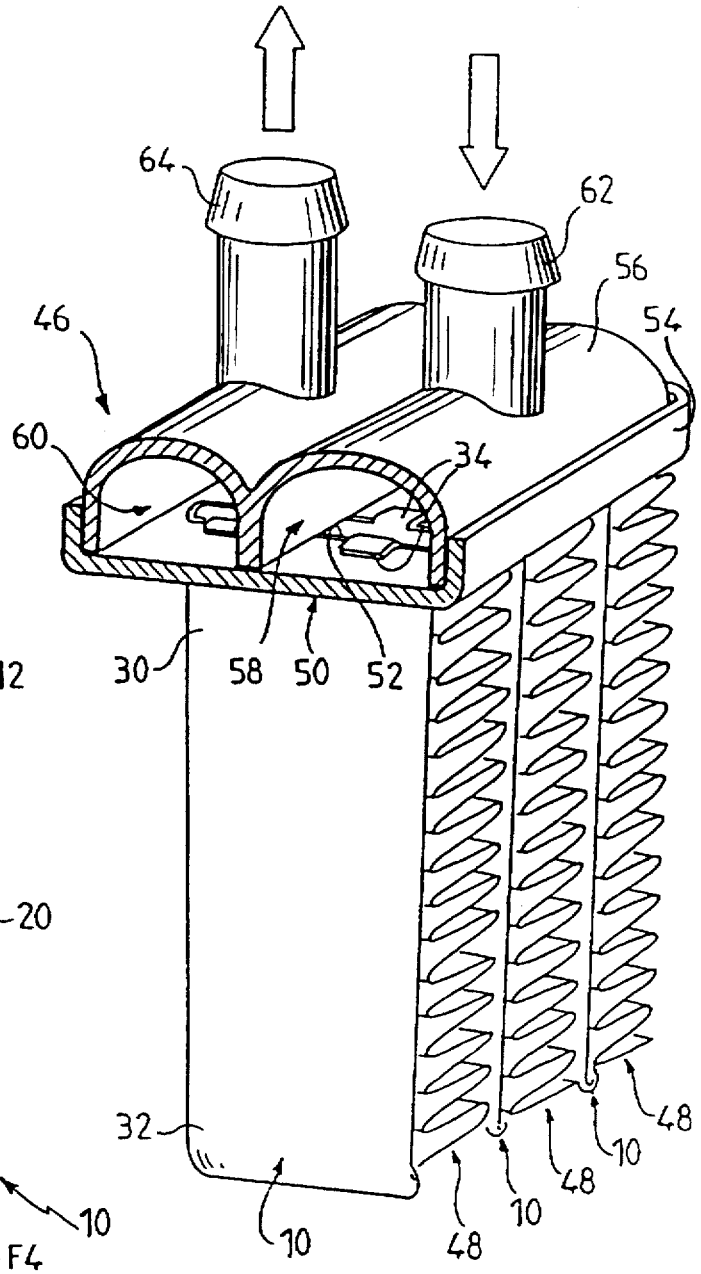
FIG. 2

HEAT EXCHANGER TUBE WITH DUCTS FOR COUNTER CURRENT FLUID FLOW

FIELD OF THE INVENTION

This invention relates to a tube adapted to form part of a heat exchanger such as a cooling radiator for the engine of a motor vehicle. More particularly, the invention relates to a heat exchanger tube, comprising a sheet metal blank press-formed and rolled on itself so as to form a casing that defines, within the casing, two parallel ducts for the flow of a fluid therein in counterflow mode, with a longitudinal separating bulkhead between the two ducts, and the tube having a first end portion adapted to be connected to a header having two compartments which are adapted to communicate respectively with the two said ducts.

BACKGROUND OF THE INVENTION

It is known from European patent specification No. EP 0 632 245A to provide a heat exchanger comprising a multiplicity of tubes of the particular type defined above. In this known type of heat exchanger, corrugated spacers are also arranged between the tubes, these spacers defining cooling fins. Various components of that heat exchanger are made in aluminium or aluminium alloy, and they are assembled together by brazing.

In addition, each of the tubes in that heat exchanger has a second end. These second ends are closed by a closure plate disposed on the opposite side of the tubes from the header. In each of these tubes the bulkhead is interrupted in the vicinity of the second end of the tube so as to enable the fluid flowing in the latter to change its direction of flow, with the fluid first flowing in a first duct within the tube in a first direction, and then in a second duct of the same tube in the opposite direction, that is to say flow takes place within the tube in a counter-flow mode.

As a result, the fluid enters via one of the compartments of the fluid header, and then flows in the respective first ducts of the tubes, so constituting a first mass of fluid flowing in a given flow direction, after which it passes into the respective second ducts so as to constitute a second mass flowing in the opposite direction. It then reaches the other compartment of the fluid header so as to leave the heat exchanger.

One of the problems posed by this type of heat exchanger is that the fluid is sharply diverted by the closure plate situated at the second end of each tube, which leads to loss of energy, for example by turbulence and cavitation. It can in addition give rise to wear problems due to the impact of the fluid on the closure plate as the latter changes the flow direction.

DISCUSSION OF THE INVENTION

A main object of the invention is to overcome the above mentioned drawbacks.

According to the invention in a first aspect, a heat exchanger tube, comprising a sheet metal blank press-formed and rolled on itself so as to form a casing that defines, within the casing, two parallel ducts for the flow of a fluid therein in counterflow mode, with a longitudinal separating bulkhead between the two ducts, and the tube having a first end portion adapted to be connected to a header having two compartments which are adapted to communicate respectively with the two said ducts, is characterised in that the tube has a second end portion which is closed individually, i.e. it includes means closing off the second end portion independently of any other component of the heat exchanger, whereby to obturate the two ducts of the tube, and in that at least two communication apertures are formed at selected locations in the longitudinal bulkhead of the tube, in the region of the said second end of the tube, for enabling the fluid to pass from one duct to the other.

Due to the fact that the second end of each tube is closed individually, and that the communication apertures are formed in the longitudinal bulkhead within the tube, the change of direction of flow of the fluid as it passes from the first duct to the second takes place quite gently, so minimising any energy losses. The communication apertures perform the function of dampers at the same time, because the fluid is able to pass from the first duct to the second in several places which are spaced apart axially along the bulkhead in the tube. In addition, mechanical strength is greatly improved in the region of the second end of the tube.

The second end of the tube is preferably closed by suitable deformation of the metal of the casing, which avoids the need to have recourse to a closure plate as in the heat exchanger in the above mentioned prior art document.

The communication apertures are preferably of generally rectangular form.

According to a preferred feature of the invention, the longitudinal separating bulkhead is constituted by at least one internal flange of the casing, formed by bending into the interior of the tube. In this case, it is preferred that the communication apertures are at least partly defined by elements projecting from at least one of the flanges of the casing which define the bulkhead.

In one embodiment of the invention, the casing comprises a flat first major wall, a flat second wall, and two substantially semicircular minor walls joining the said first and second walls together, the said second wall being constituted by two opposed wall portions of the sheet metal blank bent back at right angles to form flanges, which are juxtaposed so as to constitute the separating bulkhead. Thus, the separating bulkhead consists of two bent-back flanges joined together, and has a double thickness.

According to another preferred feature of the invention, the tube is extended beyond its first end portion by at least two opposed lugs for fastening the tube to a header plate of a header. This enables the tube to be fixed temporarily to the header plate before the whole heat exchanger is bonded together by brazing.

According to the invention in a second aspect, a heat exchanger includes a multiplicity of tubes according to the said first aspect of the invention, the said tubes being disposed parallel to each other, with each said tube being connected to a fluid header having two longitudinal compartments, so that all of the tubes have a first duct connected to a first one of the said compartments and a second duct which is connected to a second one of the said compartments, so as to permit flow of fluid in a U-shaped configuration defining two parallel masses of flowing fluid.

According to a further feature of the invention, the heat exchanger further includes corrugated spacers disposed between the tubes. The heat exchanger of the invention is preferably assembled, as already mentioned, by brazing.

Further features and advantages of the invention will appear more clearly on a reading of the following detailed description of a preferred embodiment of the invention, which is given by way of non-limiting example only and with reference to the accompanying drawings.

BRIEF DESCRIPTION OF THE DRAWINGS

FIG. 1 is a perspective view, shown partly cut away, of part of a heat exchanger tube in accordance with the invention.

FIG. 2 is a perspective view in cross section, showing part of the heat exchanger having a multiplicity of the tubes shown in FIG. 1.

DESCRIPTION OF A PREFERRED EMBODIMENT OF THE INVENTION

Reference is first made to FIG. 1, which shows a tube 10 formed from a sheet metal blank, for example aluminium or aluminium alloy, which is stamped out and rolled on itself so as to form a casing which defines two parallel ducts 12 and 14 for the flow of a fluid in a counterflow mode within the casing.

The casing has a flat first major wall 16, with two substantially semicircular minor walls 18 and 20, together with a flat second major wall. The metal blank has two longitudinal edges defined on marginal wall portions, each of which is joined to a further wall portion 22, 24. When the casing is formed, the wall portions 22 and 24 together constitute the second major wall, the marginal walls portions, 26 and 28, being bent back at right angles to form flanges. The two flanges 26 and 28 are backed against each other, and abut against the internal face of the flat major wall 16, thereby defining a longitudinal bulkhead which separates the two ducts 12 and 14.

The tube 10 has a first end portion 30 and a second end portion 32. It is extended, beyond its first end portion 30, by two pairs of opposed lugs 34, the purpose of which will be explained later herein. In addition, the casing of the tube 10 is deformed at its second end 32, so as to form a curl or seam 36, thereby closing the tube and obturating the ducts 12 and 14 at the lower end 32.

As can be seen in the bottom part of FIG. 1, the separating bulkhead 26, 28 includes in the vicinity of the lower end 32 of the tube, three communication or flow apertures 38, 40 and 42, which are located in selected positions. The aperture 38 results from interrupting the bulkhead 26, 28 beyond a transverse terminal edge 44 of the bent-back flanges 26 and 28. The aperture 38 thus extends between the terminal edge 44 and the end portion 32 of the tube, at the level of the seam 36. The communication aperture 38 is thus substantially rectangular in form.

The apertures 40 and 42 are also rectangular in this example, but these result from giving the flanges 26 and 28 a particular configuration, i.e. by forming appropriate cut-outs in the latter.

The ducts 12 and 14 therefore communicate with each other in the region of the end portion 32, through the three communication apertures 38, 40 and 42 in their selected positions along the separating bulkhead. Thus, a fluid can penetrate into the duct 12 at the level of the top end 30 (in the direction of the arrow F1), and subsequently reach the duct 14 through the communication apertures 38, 40 and 42 (as indicated by the arrows F2, F3 and F4). The fluid then flows in the duct 14 in counterflow mode (as indicated by the arrow F5), to leave the duct 14 through the end 30 of the tube 10. The flow of the fluid from the duct 12 to the duct 14 through these apertures 38, 40 and 42 is accordingly quite gentle, and may be laminar, with a minimum of energy loss, the three flow apertures acting as dampers.

Reference is now made to FIG. 2, which shows a heat exchanger 46 having a multiplicity of tubes 10 which are identical, or similar, to the one just described with reference to FIG. 1. The tubes 10 are arranged parallel to each other, and corrugated spacers 48, constituting cooling fins, are disposed between the major walls, facing towards each other, of two adjacent tubes.

The respective end portions 30 of the tubes 10 are joined to a header plate 50, which has a row of holes 52 such that the ducts 12 and 14 of any one tube 10 are open in line with a respective hole 52. The end portion 30 of each tube 10 is held in engagement against the header plate 50, and the lugs 34 are then bent back as shown in FIG. 2, so as to provide temporary retention of the tubes 10 on the header plate 50.

The header plate 50 includes a peripheral flange 54, into which a header 56, defining two internal compartments 58 and 60, is fitted. These two compartments 58 and 60 are parallel to each other. The compartment 58 is an inlet compartment and communicates with the ducts 12 of the tubes 10, while the compartment 60 is an outlet compartment in communication with the ducts 14 of the tubes 10.

In addition, the header 56 has an inlet pipe branch 62 and an outlet pipe branch 64, which are in communication with the compartments 58 and 60 respectively, so as to provide a fluid inlet and outlet respectively as indicated by the broad arrows. Thus a fluid is able to penetrate into the inlet compartment 58 through the inlet pipe branch 62, and flows from the compartment 58 into the ducts 12 of the tubes 10, and from there into the ducts 14 and so to the outlet compartment 14, leaving the latter via the outlet pipe branch 64.

In this way, the fluid flow takes the form of a downwardly flowing or first mass of fluid, divided between the ducts 12, and an upwardly flowing or second mass of fluid divided between the ducts 14. In each tube the transition between the two flow masses takes place gently and with minimum energy loss, by virtue of the apertures 38, 40 and 42 as already described.

The heat exchanger 46 in FIG. 2 is preferably made from aluminium or aluminium alloy components clad with braze metal, which enables them to be bonded together by passing them through an appropriate oven. Such a heat exchanger can be used in particular as a cooling radiator for the engine of a motor vehicle, or as a heating radiator for the cabin of a motor vehicle. In either case, the fluid that flows through the heat exchanger is the coolant fluid for the engine of the vehicle.

It will be understood that the heat exchanger only requires a single header, which enables the weight and overall size of the heat exchanger to be reduced. At the same time the material costs and the number of manufacturing operations are reduced.

The invention is of course not limited to the embodiment described by way of example with reference to the drawings, and it does extend to other versions. For instance, the separating bulkhead in each tube may be made in a different form by bending one or two edges of the sheet metal blank. The communication apertures formed in the bulkhead may be made in forms other than rectangular.

What is claimed is:

1. A heat exchanger tube comprising a casing consisting of a press-formed metallic blank rolled on itself and defining two parallel ducts for counter-current flow of a fluid therein and a longitudinal separating bulkhead between the two ducts, the tube having a first end for connection to a fluid header, and a second end, wherein the casing defines means closing the said second end, obturating the said ducts, a plurality of communication apertures being formed in the bulkhead at selected locations in the region of the said second end, for passage of fluid from one said duct to the other.

2. A heat exchanger tube according to claim 1, wherein the material of the casing is deformed whereby to close the second end.

3. A heat exchanger tube according to claim 1, wherein the said communication apertures are generally rectangular.

4. A heat exchanger tube according to claim 1, wherein the casing has at least one flange bent into the interior of the tube so as to form the said bulkhead.

5. A heat exchanger tube according to claim 1, wherein the casing has flanges, at least one of which defines the bulkhead and which is formed with projections at least partly defining the said communication apertures.

6. A heat exchanger tube according to claim 1, wherein the blank has two opposed side edges, two marginal wall portions each containing a said side edge, and a further wall portion joined to each said marginal wall portion, the casing having a flat first major wall, a second flat major wall constituted by the said further wall portions joined together, with the said marginal wall portions being bent inwardly as flanges from the junction between the said further wall portions so as to constitute the separating bulkhead, and the tube further having two substantially semicircular minor walls joining the said first and second major walls.

7. A heat exchanger tube according to claim 1, further having two opposed lugs for fastening the tube to a header plate, the said lugs extending the first end portion of the tube.

8. A heat exchanger comprising a fluid header having two longitudinal compartments, and a multiplicity of tubes according to claim 1 disposed parallel to each other and fixed to the header, with all of the said first ducts being open into one said compartment and all of the said second ducts being open into the other compartment, whereby to define a U-shaped flow path for fluid in two parallel masses of fluid between the two said compartments.

9. A heat exchanger according to claim 8, further including corrugated spacers between the tubes.

10. A heat exchanger according to claim 8, assembled by brazing.

* * * * *